US009671155B2

(12) United States Patent
Delgadillo

(10) Patent No.: US 9,671,155 B2
(45) Date of Patent: Jun. 6, 2017

(54) CYLINDER PAN CHILLER

(71) Applicant: Hector Delgadillo, Duarte, CA (US)

(72) Inventor: Hector Delgadillo, Duarte, CA (US)

( * ) Notice: Subject to any disclaimer, the term of this patent is extended or adjusted under 35 U.S.C. 154(b) by 0 days.

(21) Appl. No.: 14/821,720

(22) Filed: Aug. 8, 2015

(65) Prior Publication Data

US 2016/0242570 A1 Aug. 25, 2016

Related U.S. Application Data

(63) Continuation-in-part of application No. 14/635,245, filed on Mar. 2, 2015, which is a continuation-in-part of application No. 13/970,041, filed on Aug. 19, 2013, now Pat. No. 9,353,986.

(60) Provisional application No. 61/766,504, filed on Feb. 19, 2013.

(51) Int. Cl.

| | |
|---|---|
| ***F25D 23/06*** | (2006.01) |
| ***F25D 13/00*** | (2006.01) |
| ***F25D 17/02*** | (2006.01) |
| ***F25D 11/00*** | (2006.01) |
| ***F25D 31/00*** | (2006.01) |
| *A47F 3/04* | (2006.01) |
| *A47F 10/06* | (2006.01) |

(52) U.S. Cl.

CPC ..... *F25D 23/061* (2013.01); *F25D 11/00* (2013.01); *F25D 31/00* (2013.01); *A47F 3/0486* (2013.01); *A47F 10/06* (2013.01); *F25D 17/02* (2013.01)

(58) Field of Classification Search

CPC ..... F25D 31/00; F25D 31/003; F25D 23/068; F25D 23/006; F25D 23/066; F25D 23/061; F25D 23/063; F25D 23/06; F25D 11/00; F25D 17/02; F25D 2400/10; Y10T 29/49879

USPC ..... 62/99, 451, 185, 458; 99/517; 165/104.14; 220/592.05, 592.26, 23.88; 29/455.1

See application file for complete search history.

(56) References Cited

U.S. PATENT DOCUMENTS 2,318,414 A * 5/1943 Palmer ..... F25D 31/006 220/560.04
4,378,625 A * 4/1983 Crisman ..... B65D 25/02 29/235
5,181,395 A 1/1993 Carpenter et al.
5,355,687 A 10/1994 Carpenter et al.

(Continued)

FOREIGN PATENT DOCUMENTS

KR WO 2009145444 A2 * 12/2009 ..... A47B 13/16

*Primary Examiner* — Ryan J Walters
*Assistant Examiner* — Joseph Trpisovsky
(74) *Attorney, Agent, or Firm* — Steven A. Nielsen; www.NielsenPatents.com

(57) ABSTRACT

A glycol pan chiller is configured in a unique cylinder form factor that achieves new efficiencies in power savings and cooling. A new cylindrical cooling assembly comprises three concentrically disposed cylinders attached together at their respective top ends to create an upper lip area 219 or shelf area that provides top end insulation and a useful shelf area. The concentrically disposed cylinders define an outward void for insulation, a middle void for refrigerant tubing and retained refrigerant or cooling fluid such as glycol and an inner void 224 for food storage and food cooling. Food cooled within the inner void is not dried out as heat transfer occurs without blowing air within the inner void.

12 Claims, 4 Drawing Sheets

(56) References Cited

U.S. PATENT DOCUMENTS

| | | | | |
|---|---|---|---|---|
| 5,927,092 | A | 7/1999 | Kushen et al. | |
| 6,145,333 | A * | 11/2000 | Richmond | A47F 3/0439 219/385 |
| 6,179,155 | B1 * | 1/2001 | Komiya | A47J 41/0072 220/560.13 |
| 8,250,881 | B1 * | 8/2012 | Reihl | F25D 11/006 62/180 |
| 2006/0196631 | A1 * | 9/2006 | Small | F25D 16/00 165/10 |
| 2006/0201177 | A1 | 9/2006 | Spillner | |
| 2006/0230948 | A1 | 10/2006 | Matus | |
| 2007/0145051 | A1 * | 6/2007 | Uffner | B62B 3/02 220/4.28 |
| 2009/0013707 | A1 | 1/2009 | Spillner | |
| 2013/0333400 | A1 * | 12/2013 | Hess | F25D 31/00 62/62 |

* cited by examiner

CYLINDER PAN CHILLER

CROSS-REFERENCE TO RELATED APPLICATIONS

This is a utility application is a continuation in part or CIP of U.S. patent application Ser. No. 14/635,245 filed on or about Mar. 2, 2015 which is a CIP of Ser. No. 13/970,041 filed on or about Aug. 19, 2013 which is based upon and claims the benefit of U.S. provisional patent application Ser. No. 61/766,504, entitled "Glycol Pan Chiller Systems" filed on Feb. 12, 2013. These related applications are incorporated herein by reference and made a part of this application. If any conflict arises between the disclosure of the invention in this utility application and that in the related applications, the disclosure in this utility application shall govern. Moreover, the inventors incorporate herein by reference any and all patents, patent applications, and other documents hard copy or electronic, cited or referred to in this application.

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever. Such trademark(s) may include, "Turbo Coil."

BACKGROUND OF THE INVENTION (1) Field of the Invention

The invention generally relates to refrigeration systems. More particularly, the invention relates to means and methods of producing and using glycol pan chiller systems in cylindrical embodiments for specialized food preparation and food cooling.

(2) Description of the Related Art

The use of glycol in cooling systems is known in general, but the prior art fails to teach, suggest or motivate one skilled in the art to construct the disclosed embodiments using a cylindrical form factor and other disclosed features.

Several systems by KAIRAK are known in the art. For example U.S. Pat. No. 5,181,395 "Condenser Assembly", U.S. Pat. No. 5,927,092 "Food Pan Refrigeration Unit" and U.S. Pat. No. 5,355,687 "Pan Cooler and Method" disclose various refrigeration systems. While the known KAIRAK patents disclose various physical configurations of assembling cooling systems the KAIRAK patents fail to address the shortfalls in the art. The KAIRAK compressor and pump are almost always in operation. The KAIRAK system contemplates a traditional single food compartment system.

The known relevant published patent applications teach means and methods of protecting food held in a chiller and blowing cold air over food. Such published patent applications include 20090013707 Air blanketed food preparation table; 20060230948 Food Protector Apparatus that Attaches to a Drop-In Food pan and method and 20060201177 Air Blanketed Food Preparation Table. Thus, the trend in the art is to focus upon the protection of food in a chiller, blowing cold air directly upon food and to remain satisfied with the chilling methods of the prior art.

There are many shortfalls in the prior art. For example, the chillers of the prior art typically use twenty year old technology and fail to artfully integrate the use of both glycol and Freon systems. Chillers in the prior art fail to efficiently and economically cool chill pans and related assemblies. For example, chillers of the prior art often use non removable foam material to encase Freon lines wrapping a chiller. When a Freon line leaks, the unit is not economically repairable. The prior art is prone to condensation problems as well. The prior art is prone to blow cold air directly upon food, causing condensation problems and problems with drying out food. The prior art also fails to leverage chilled fluid, such as glycol to cool multiple compartments.

BRIEF SUMMARY OF THE INVENTION

The present invention overcomes shortfalls in the related art by presenting an unobvious and unique combination and configuration of liners, liner installation systems, use of Freon lines, use of glycol flowing in contact with Freon lines, with the glycol in a static state or moving state, with Freon lines chilling glycol within a new cylindrical cooling assembly. The disclosed cylindrical cooling assembly is uniquely configured to maximize cooling and to minimize energy consumption.

The disclosed cylindrical cooling assembly overcomes shortfalls in the art by use of an upper lip area or shelf area that provides a round smooth surface ideal for hanging items in the cooling compartment and provides an insulated upper section by the artful use of various components that may include three concentric cylinders, an upper horizontal outer ring, circular rings, outer bands and other components. The disclosed cylindrical cooling assembly overcomes shortfalls in the art by providing an assembly that is made of simple parts that are economical to fabricate and assemble. The disclosed cylindrical cooling assembly overcomes shortfalls in the art by providing a space efficient cooling chamber that is well suited for the cooling of pancake batter and other specialty items that are often set up in a commercial environment on a temporary or ad hoc basis. The disclosed cylindrical cooling assembly is very portable and easily adapts to any environment where refrigeration lines are found.

Disclosed embodiments overcome shortfalls in the art by use of a cylindrical chiller pan assembly comprising an inner circular cooling compartment, that is cooled within an inner liner area comprised of Freon lines surrounded by free flowing or static glycol. The Freon lines contain Freon or other fluid cooled by a single or relatively small number of refrigeration condensing and compressor units. The Freon lines wrap around an inner cylinder area and cool the surrounding glycol or other fluid. The contents of the inner circular void area, cooling chamber or food storage area are cooled indirectly by heat transfer into the Freon lines and surrounding glycol. The Freon lines remove heat from both the inner circular cooling compartment and the surrounding glycol.

The present invention overcomes shortfalls in the art by eschewing the practice of blowing chilled air over food held in a cooling area used for quick food access. This solution is known to dry out food. The prior art disclosures also teach methods of blowing cool air to the undersides of a pan chiller or pan containing food. The utility of blowing cool air to the undersides of a chiller is severely limited by the thermal properties of air. In acknowledgement of this shortfall, KAIRAK U.S. Pat. No. 5,927,092 uses cooling fins attached to a pan chiller in an effort to improve its air cooled system. In the automotive industry, air cooled engines were replaced long ago with liquid cooled engines. But, KAIRAK remains entrenched in the prior art and teaches away from the liquid cooled systems of the present invention.

Disclosed embodiments have provided unexpected and dramatically favorable results in cooling efficiency by ignoring the air fins and air cooling system of KAIRAK and by using a new cylindrical cooling assembly comprising a Freon line wrapped between concentrically disposed cylinders. A cylindrical inter void area is filled with glycol or other coolant fluid which is cooled by Freon or any other refrigerant.

Disclosed embodiments include the artful and unobvious combination of cylinders retained within other cylinders to efficiently chill pancake mix and other food products where maximizing cooling surface area is advantageous.

These and other objects and advantages will be made apparent when considering the following detailed specification when taken in conjunction with the drawings.

REFERENCE NUMERALS IN THE DRAWINGS

Figure 1:
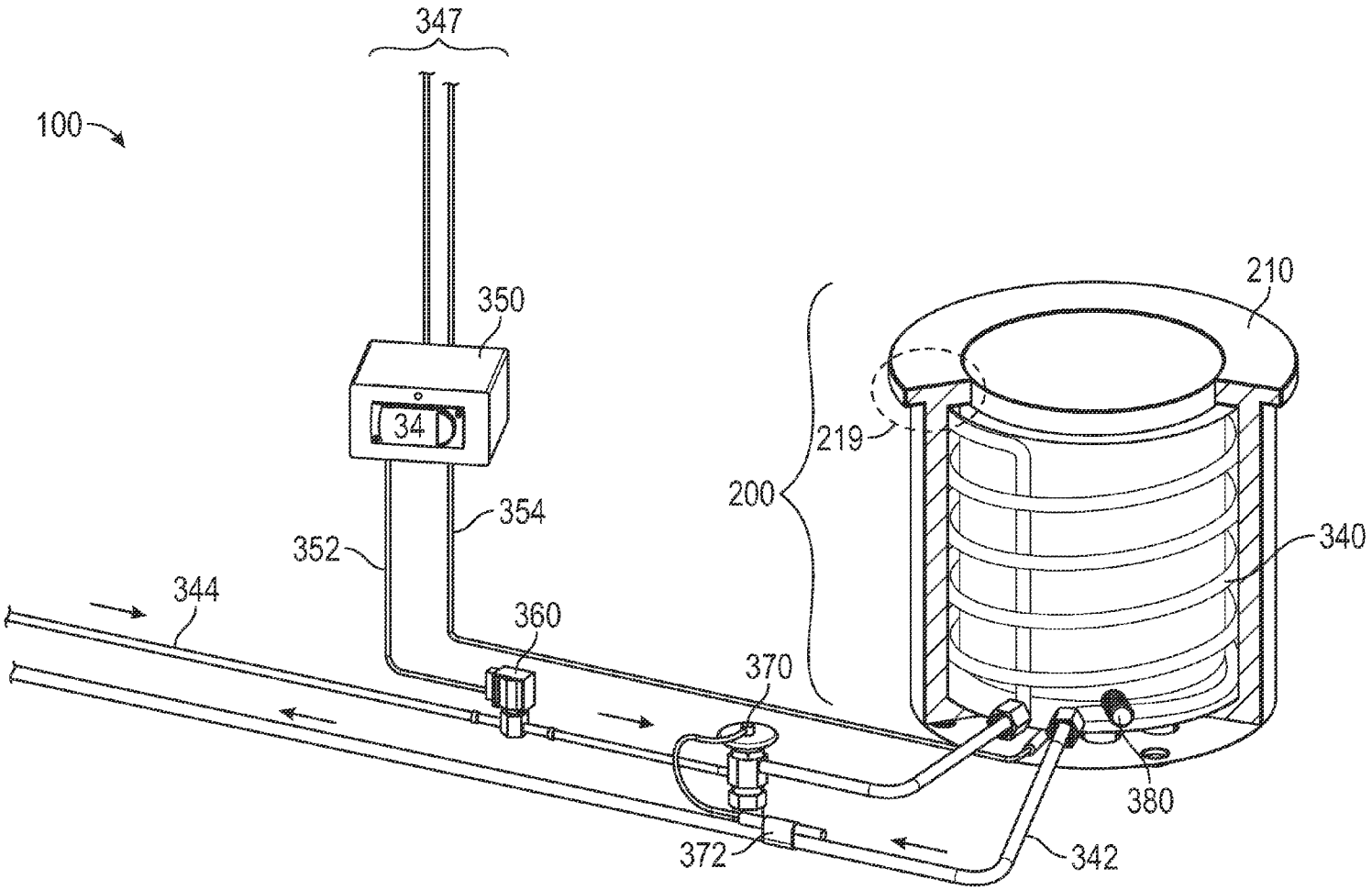
FIG. 1 depicts an overall system

100 a disclosed system in general
200 cylindrical cooling assembly in general
210 upper horizontal outer ring
212 outer circular circumference of upper horizontal outer ring 210
213 inner circular circumference of upper horizontal outer ring 210
214 inner circular void defined within upper horizontal outer ring 210
216 top side of upper horizontal outer ring 210
218 bottom side of upper horizontal outer ring 210
219 upper lip area or shelf area
220 inner cylinder or pan chiller cylinder
222 outer wall of inner cylinder 220
223 inner wall of inner cylinder 220
224 inner void or cooling chamber defied within inner wall 223 of inner cylinder 220 500
226 top side or top edge of inner cylinder 220
228 bottom side of inner cylinder 220
230 circular bottom plate of inner cylinder 220
232 outer circular circumference of circular bottom plate 230
240 circular ring of middle tank or glycol tank cylinder 250
242 outer circular circumference of circular ring 240 of glycol tank cylinder 250
243 inner circular circumference of circular ring 240
244 inner circular void defined within circular ring 240
250 glycol tank cylinder or middle tank
252 outer wall of glycol tank cylinder 250
253 inner wall of glycol tank cylinder 250
255 bottom disc of glycol tank 250
260 outer band of outer cylinder 280
262 outer circular surface of outer band 260
263 inner circular surface of outer band 260
264 inner void defined within outer band 260
266 top side of outer band 260
268 bottom side of outer band 260
269 circular vertical wall section
270 outer ring of outer cylinder 280
272 outer surface of outer ring 270
273 inner circular circumference of outer surface 272
274 inner void defined within outer ring 270
276 top side of outer ring 270
278 bottom side of outer ring 270
280 outer cylinder
282 outer wall of outer cylinder
283 inner wall of outer cylinder
286 top side of outer cylinder
288 bottom side of outer cylinder
289 utility voids defined within outer cylinder
290 bottom plate of outer cylinder 280
310 threaded coupling
314 nipple
318 pipe adapter
320 sensor probe
340 Freon flow line or refrigerant tube wrapped between inner cylinder
220 and glycol tank 250
342 Freon or refrigerant out flow line
344 Freon or refrigerant inflow line
347 electrical supply lines to thermostat 350
350 thermostat
352 thermostatic control line for solenoid valve 360
354 thermostatic line to receive temperature reading from sensor 320
360 solenoid valve connected to Freon inflow line 344
370 TXV valve in connection with Freon inflow line 344
372 TXV sensor
380 drain
400 insulation
500 glycol or other fluid

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Referring to FIG. 1, a disclosed system 100 may comprise a cylindrical cooling assembly 200 attached to a Freon inflow line 344 and a Freon outflow line 343. The Freon inflow line 344 may be attached to a solenoid valve 360 and the solenoid valve 360 may be attached to a thermostatic control line 352 which may be attached to a thermostat 350. The thermostat 350 may be connected to power lines 347 and connected to a thermostatic line 354 to receive temperature information from a sensor 320 (shown in FIG. 2). A TXV valve 370 may be connected to the Freon inflow line 344 while a TXV sensor 372 may be connected to the Freon outflow line 372.

In general, the Freon may be cooled by any traditional means or by a Turbo Coil system. The cooled Freon enters the cylindrical cooling assembly 200 by use of the Freon inflow line 344. The cooled Freon circulates in a spiral fashion within a Freon line 340 contained between an inner cylinder 220 or pan chiller cylinder and glycol tank cylinder 250 or middle tank, as shown in FIG. 2.

Figure 2:
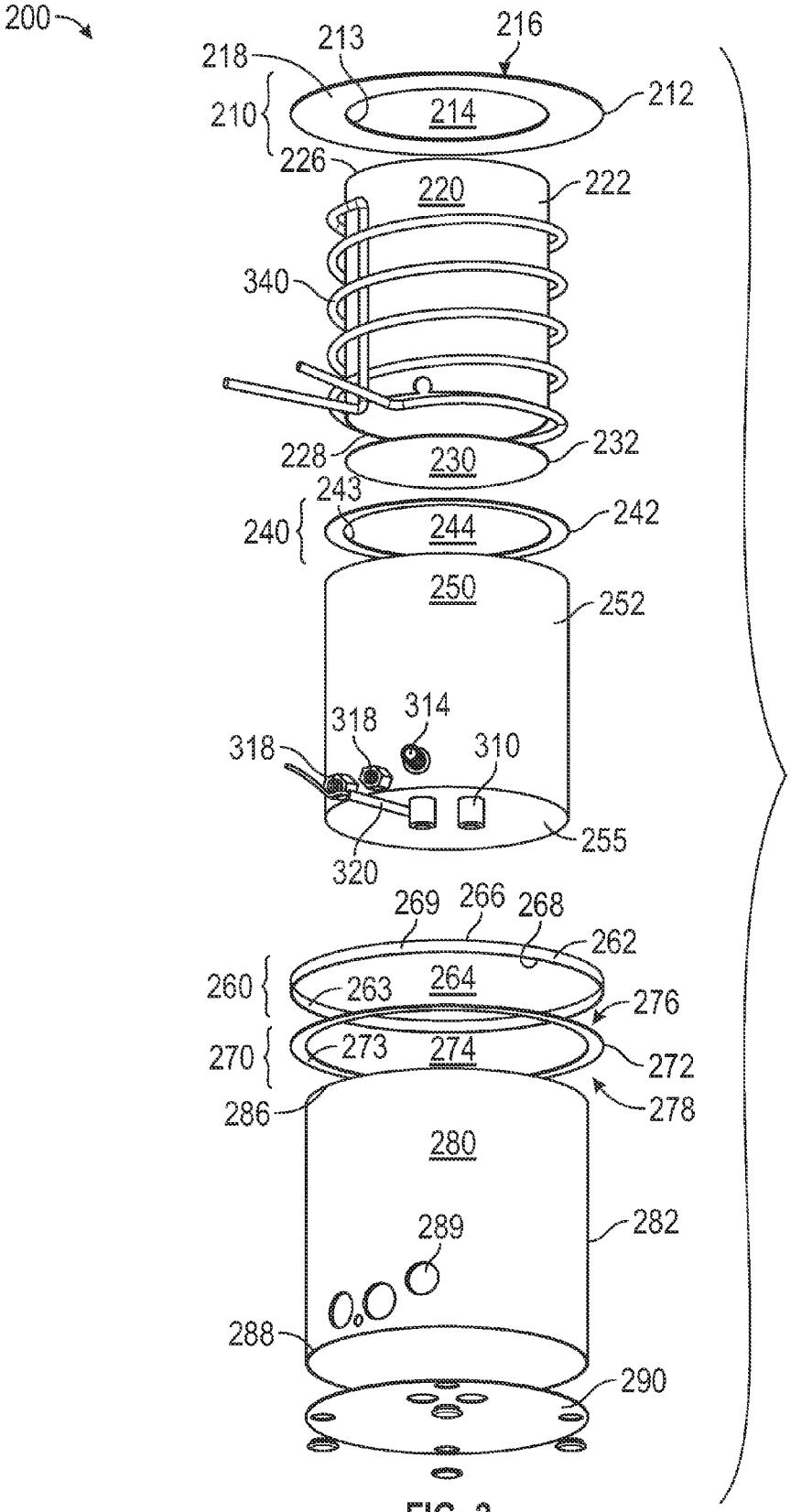
FIG. 2 depicts an exploded view of a cylindrical cooling assembly

Referring to FIG. 2, a disclosed cylindrical cooling assembly 200 may comprise three cylinders in concentric formation that facilities the efficient cooling of items contained within an inner cylinder 220 or pan chiller cylinder. The inner cylinder 220 may comprise an outer wall 222 and an inner wall 223 (shown in FIG. 5) with the outer wall supporting, in contact with or adjacent to a spiral Freon line 340. The inner cylinder 220 may have a top edge 226 that comports to the inner circular circumference 213 of an upper horizontal outer ring 210. The artful configuration of the inner cylinder 220 and upper horizontal outer ring 210 allows for an efficient and strong assembly of the cylindrical cooling assembly 200 as the upper horizontal outer ring 210 spans all three concentrically assembled cylinders to provide rigid support.

The upper horizontal outer ring 210 may comprise an outer circular circumference 212, an inner circular circumference 213 with the inner circular circumference 213 defining an inner circular void 214 allowing for access to the inner cylinder 220. The upper horizontal outer ring 210 may further include a top side 216 and a bottom side 218 with the bottom side connected to other components and the topside providing an upper shelve or upper lip area to house insulation at the upper portions of the assembly. The upper lip area or top side 216 provides a resting shelf for cooling inserts such as Bain Marie inserts. The inner cylinder 220 may include a bottom edge 228 that may be attached to circular bottom plate 230 to retain the cooled contents of the inner cylinder.

A circular ring 240 of the middle tank or glycol tank 250 may provide an upper barrier to the Freon line and glycol void area defined between the inner cylinder 220 and the glycol tank 250. The circular ring 240 provides an advantage of defining an upper portion of the glycol void area such that the upper lip area 219 (shown on FIG. 3) may be thickly insulated. The circular ring 240 may comprise an outer circular circumference 242 and an inner circular circumference 243 that defines an inner circular void 244. The inner circular void 224 may comport to the outer wall of the inner cylinder while the outer circular circumference may comport to the inner wall of the middle tank or glycol tank cylinder.

Figure 5:
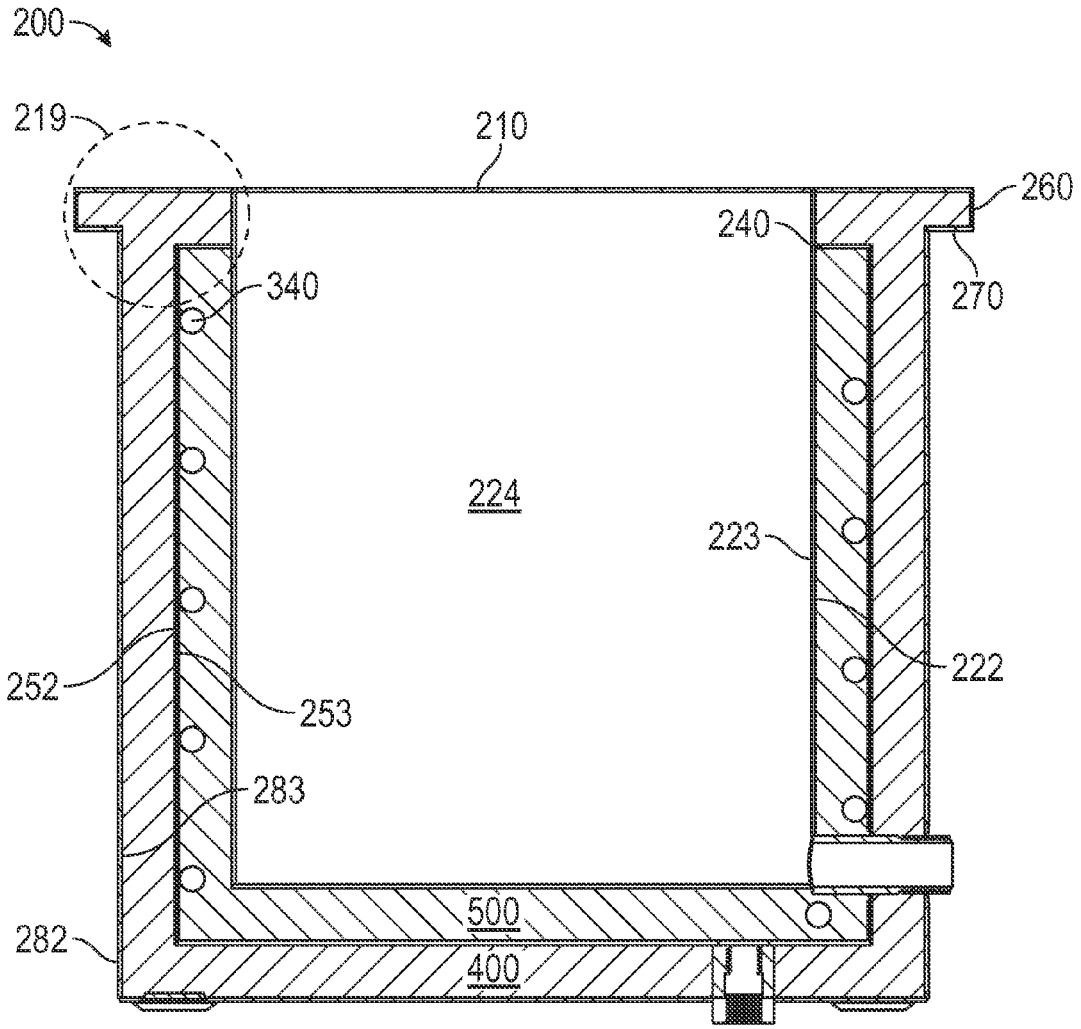
FIG. 5 depicts a sectional view of a cylindrical cooling assembly

A middle tank or glycol tank cylinder 250 may comprise an outer wall 252 and an inner wall 253 (shown in FIG. 5). The glycol tank cylinder 250 may be of lesser height as compared to the inner cylinder so as to accommodate the lip area. The glycol tank 250 may define voids for or comprise a nipple 314, one or more pipe adapters 318 that may be used with Freon lines, one or more threaded couplings 310 and a sensor probe 320. The sensor probe 320 placement overcomes shortfalls in the related art by attachment to the middle tank where Freon temperature is relatively stable and not immediately affected by the contents of the inner cylinder. The glycol tank may include a bottom disc 255 to retain insulation or to support the threaded couplings.

The use and configuration of the outer band 260 and outer ring 270 of the outer cylinder 280 overcome shortfalls in the art by supporting the upper lip area, the separation of the three concentric cylinders and by providing means of containing insulation within the upper lip and between the glycol cylinder and the outer cylinder.

The outer band 260 of the outer cylinder 280 may comprise an outer circular surface 262, an inner circular surface 263 defining an inner void, a top side 266 and a bottom side 268 as well as a circular vertical wall section 269. The top side 266 may fit to or comport with the circular ring 240 of the glycol tank while the bottom side of the outer band may fit to or comport with the outer ring 270 of the outer cylinder 280.

The outer cylinder 280 may comprise an outer surface 282 or outer wall, an inner surface or inner wall 283, a top side 286 or top edge, a bottom side 288 and define various utility voids 280. A bottom plate 290 may define various voids and comport with the bottom side or bottom edge 288 of the outer cylinder 280.

Figure 3:
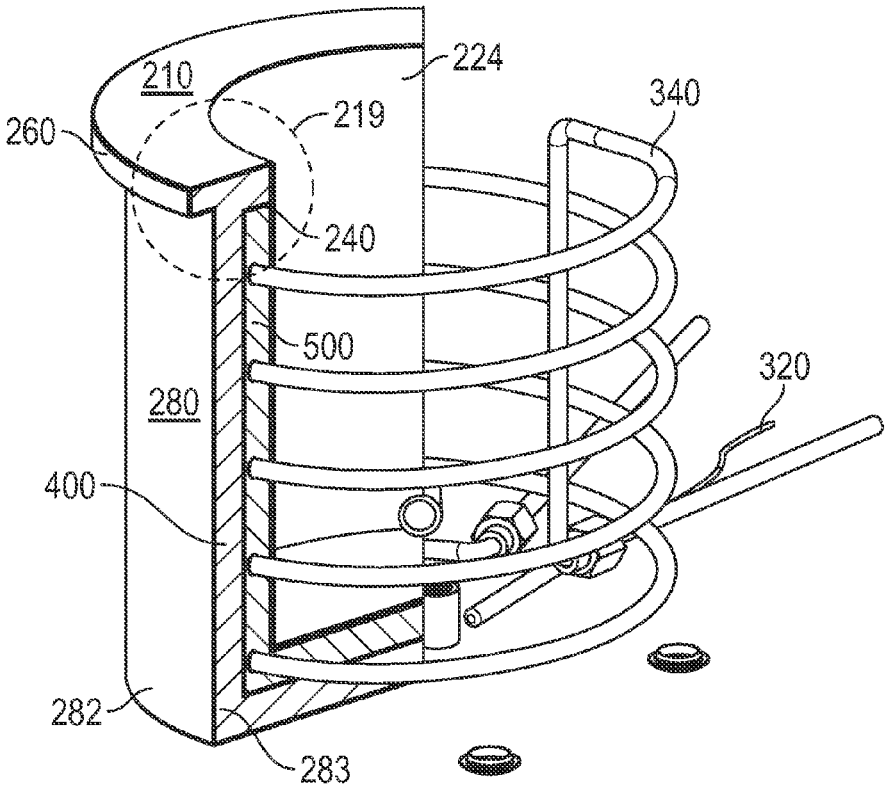
FIG. 3 depicts a perspective view of a cylindrical cooling assembly

FIG. 3 depicts perspective and sectional view of a cylindrical cooling assembly comprising an upper lip area 219 or shelf area which may comprise an area of insulation 400 retained within an upper horizontal outer ring 210, an outer wall of the inner cylinder, the upper surface of the circular ring 240 of the middle cylinder, the inner wall or side of the outer cylinder, the upper side of the outer ring 290 of the outer cylinder and the inner side of the outer band 260 of the outer cylinder. The upper lip area overcomes shortfalls in the art by accommodating an insulated and flat lip area shown outwardly upon the top surface of the upper horizontal outer ring 210 and by providing top end insulation to the void area containing the glycol 500 and Freon lines 340.

The use of contained glycol 500 in contact with Freon lines with the glycol backed with insulation 400 and with the glycol in direct contact with the inner cylinder overcomes shortfalls in the art as food contained within the inner cylinder is in relatively close contact with the glycol for quick heat removal. The outer insulation 400 protects the glycol from heat transfer caused by ambient air.

Figure 4:
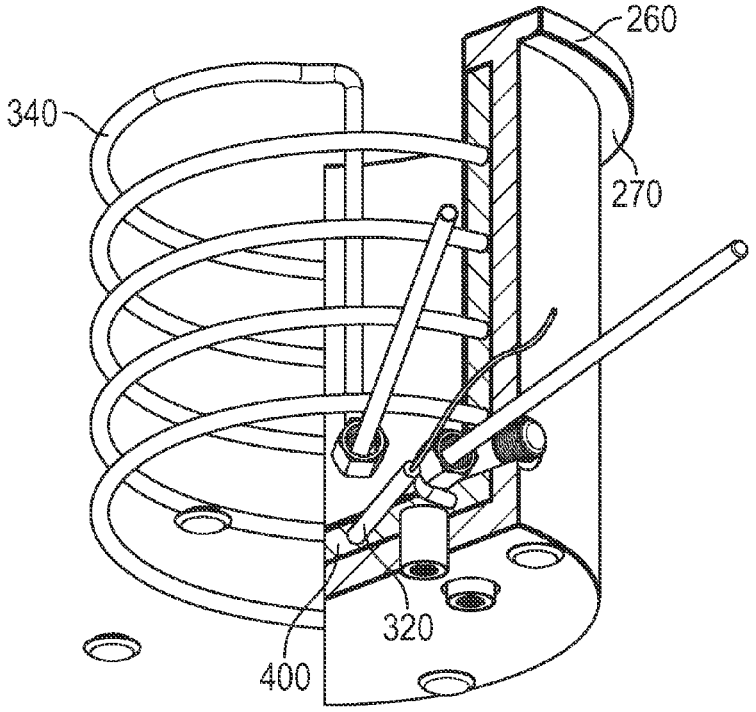
FIG. 4 depicts a perspective view of a cylindrical cooling assembly

FIG. 4 depicts various components include a sensor probe 320 inserted into insulation 400 found at the bottom portions of the assembly. This configuration overcomes shortfalls in the art as the sensor probe in not exposed to transitory changes in unit temperature.

FIG. 5 a sectional view of a cylindrical cooling assembly 200 comprising three concentrically assembled cylinder walls with each cylinder wall having inside and outside surfaces with the top ends of the three cylinders artfully terminating in an upper lip area 219 or shelf area. An outer cylinder is shown to have an outer surface 282 and inner surface 283. A middle cylinder or glycol cylinder is shown to have an outer surface 252 and an inner surface 253. An inner cylinder is shown to have an inner surface 223 and an outer surface 222. The inner surface 223 of the inner cylinder may define an inner void 224 or food storage area.

Disclosed embodiments include the following items.

Item 1. A cylindrical cooling assembly 200 for cooling food within a cooling chamber 224, the assembly comprising:

a) an upper horizontal ring 210 having an inner circular circumference 213, an outer circular circumference 212, at top side 216 and a bottom side 218, attached to an outer band 260 of an outer cylinder 280;

b) the outer band comprising an outer circular surface 262, an inner circular surface 263, a top side 266, a bottom side 268 and a circular vertical wall section 269, the outer band attached to an outer ring 270 of the outer cylinder;

c) the outer ring of the outer cylinder comprising an outer surface 272, an inner surface 273, at top side 276 and a bottom side 278;

d) the outer cylinder attached to the outer ring of the outer cylinder, the outer cylinder comprising an outer wall 282, an inner wall 283, a top side 286 and a bottom side 288, the outer cylinder attached to a bottom plate 290;

e) a middle tank 250 disposed within the outer cylinder, the middle tank attached to a circular ring 240 of the middle tank and the circular ring attached to an inner cylinder 220 disposed within the middle tank;

f) the inner cylinder comprising a top side 226, a bottom side 228, an outer wall 222 and an inner wall 223 defining the cooling chamber.

Item 2. The cylindrical cooling assembly of 1 wherein a refrigerant tube
240 is disposed between the middle tank and the inner cylinder.

Item 3. The cylindrical cooling assembly of 2 further comprising an upper lip area 219, the upper lip area comprising the upper horizontal outer ring, the topside of the inner cylinder and the circular ring of the middle tank.

Item 4. The cylindrical cooling assembly of 2 further including a circular bottom plate 230 attached to the bottom side of the inner cylinder.

Item 5. The cylindrical cooling assembly of 4 further including insulation disposed between the inner wall of the outer cylinder and the outer wall of the middle tank.

Item 6. They cylindrical cooling assembly of 5 further including a plurality of utility voids 289 defined within the outer cylinder.

Item 7. The cylindrical cooling assembly of 6 further including a temperature sensor 320 disposed at the bottom side of the middle tank.

Item 8. The cylindrical cooling assembly of 7 further including a first pipe adapter 318 and a second pipe adapter disposed upon the outer surface of the middle tank.

Item 9. The cylindrical cooling assembly of 8 wherein the refrigerant tube comprises a first end attached to the first pipe adapter and the refrigerant tube comprises a second end attached to the second pipe adapter.

Item 10. The cylindrical cooling assembly of 9 with a refrigerant inflow line attached to the first pipe adapter and with a refrigerant outflow line attached to the second pipe adapter.

Item 11. The cylindrical cooling assembly of 10 with a TXV valve connected to the refrigerant inflow line with the TXV valve comprising a TXV sensor 272 attached to the refrigerant outflow line.

Item 12. The cylindrical cooling assembly of 11 further comprising a solenoid valve connected to the refrigerant inflow line.

Item 13. The cylindrical cooling assembly of 12 further comprising a thermostat 350 comprising a thermostatic control line 352 attached to the solenoid valve and the thermostat further comprising a thermostatic line attached to the sensor.

Item 14. The cylindrical cooling assembly of 13 wherein the refrigerant inflow line and refrigerant out flow line are connected to a refrigerant cooling system.

Item 15. The cylindrical cooling assembly of 14 wherein the sensor is disposed with the insulation.

What is claimed is:

1. A cylindrical cooling assembly for cooling food within a cooling chamber, the assembly comprising:

a) an outer cylinder attached to an outer ring of the outer cylinder, the outer cylinder comprising an outer wall and an inner wall attached to a bottom plate;

b) a middle tank comprising of an outer wall and an inner wall disposed within the outer cylinder, the middle tank attached to a circular ring of the middle tank, the circular ring attached to an inner cylinder disposed within the middle tank;

c) the inner cylinder comprising an outer wall, an inner wall and an inside area of the inner all defining the cooling chamber with a circular bottom plate attached to a bottom side of the inner cylinder;

d) insulation disposed between the inner wall of the outer cylinder and the outer wall of the middle tank;

e) the inner wall of the middle tank and the outer wall of the inner cylinder defining a glycol void area in which a spiral refrigerant tube is disposed within the glycol void area;

f) glycol disposed within the glycol void area, the glycol in contact with the spiral refrigerant tube carrying a refrigerant;

g) an upper lip area, the upper lip area comprising an upper horizontal outer ring, the upper horizontal outer ring attached to an outer band of the outer cylinder, a topside of the inner cylinder and the circular ring of the middle tank.

2. The cylindrical cooling assembly of claim 1, the outer band further comprising of an outer circular surface, an inner circular surface, and a circular vertical wall section the outer band attached to the outer ring of the outer cylinder.

3. They cylindrical cooling assembly of claim 1 further including a plurality of utility voids defined within the outer cylinder.

4. The cylindrical cooling assembly of claim 1 further including a temperature sensor disposed at the bottom side of the middle tank.

5. The cylindrical cooling assembly of claim 1 further including a first pipe adapter and a second pipe adapter disposed upon the outer wall of the middle tank.

6. The cylindrical cooling assembly of claim 1 wherein the spiral refrigerant tube comprises a first end attached to the first pipe adapter and the spiral refrigerant tube comprises a second end attached to the second pipe adapter.

7. The cylindrical cooling assembly of claim 6 with a refrigerant inflow line attached to the first pipe adapter and with a refrigerant outflow line attached to the second pipe adapter.

8. The cylindrical cooling assembly of claim 7 with a TXV valve connected to the refrigerant inflow line with the TXV valve comprising a TXV sensor attached to the refrigerant outflow line.

9. The cylindrical cooling assembly of claim 8 further comprising a solenoid valve connected to the refrigerant inflow line.

10. The cylindrical cooling assembly of claim 9 further comprising a thermostat comprising a thermostatic control line attached to the solenoid valve and the thermostat further comprising a thermostatic line attached to the temperature sensor which is disposed with the insulation.

11. The cylindrical cooling assembly of claim 10 wherein the refrigerant inflow line and refrigerant out flow line are connected to a refrigerant cooling system.

12. The cylindrical cooling assembly of claim 11 wherein the sensor is disposed within the insulation.

* * * * *